US010170868B1

(12) United States Patent
Oyake et al.

(10) Patent No.: US 10,170,868 B1
(45) Date of Patent: Jan. 1, 2019

(54) CONNECTOR

(71) Applicants: JAE Electronics, Inc., Irvine, CA (US); JAPAN AVIATION ELECTRONICS INDUSTRY, LIMITED, Tokyo (JP)

(72) Inventors: Takayoshi Oyake, Irvine, CA (US); Masamichi Sasaki, Tokyo (JP)

(73) Assignees: JAE Electronics, Inc., Irvine, CA (US); Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/838,750

(22) Filed: Dec. 12, 2017

Related U.S. Application Data

(60) Provisional application No. 62/572,684, filed on Oct. 16, 2017.

(51) Int. Cl.

| | |
|---|---|
| ***H01R 13/6596*** | (2011.01) |
| ***H01R 13/6585*** | (2011.01) |
| ***H01R 13/652*** | (2006.01) |
| ***H01R 12/79*** | (2011.01) |
| ***H01R 24/60*** | (2011.01) |
| *H01R 13/627* | (2006.01) |
| *H01R 12/72* | (2011.01) |

(52) U.S. Cl.
CPC ..... *H01R 13/6585* (2013.01); *H01R 12/79* (2013.01); *H01R 13/652* (2013.01); *H01R 24/60* (2013.01); *H01R 12/727* (2013.01); *H01R 13/6273* (2013.01)

(58) Field of Classification Search
CPC ... H01R 13/6585; H01R 12/24; H01R 13/648
USPC ..... 439/108, 495, 607, 95, 631
See application file for complete search history.

(56) References Cited

U.S. PATENT DOCUMENTS

| | | | | |
|---|---|---|---|---|
| 6,524,118 | B1 * | 2/2003 | Kikuchi | H01R 24/50 439/629 |
| 6,619,985 | B1 * | 9/2003 | Ko | H01R 12/775 439/579 |
| 7,297,027 | B2 * | 11/2007 | Liang | H01R 12/79 439/607.07 |
| 7,828,589 | B2 * | 11/2010 | Cheng | H01R 13/6597 439/452 |
| 2005/0075004 | A1 * | 4/2005 | Endou | H01R 13/658 439/495 |

(Continued)

FOREIGN PATENT DOCUMENTS

JP 2005-129490 5/2005

*Primary Examiner* — Abdullah Riyami
*Assistant Examiner* — Nader Alhawamdeh
(74) *Attorney, Agent, or Firm* — Collard & Roe, P.C.

(57) ABSTRACT

A connector includes: a housing, which includes a hole portion extending forward from an insertion slot into which an object is to be inserted; a plurality of terminals, which are arranged in the hole portion; a conductive shell, which is configured to at least partially cover the housing; a grounding spring pieces, which are electrically connected to the conductive shell, and is formed at a position apart from a terminal group toward a right side or a left side so that the grounding spring pieces are brought into contact with a grounding pad of the object; and a partition wall, which extends between the terminal group and the grounding spring pieces along a front-and-rear direction, and is configured to partition the terminal group and the grounding spring pieces.

8 Claims, 9 Drawing Sheets

(56) References Cited

U.S. PATENT DOCUMENTS

2009/0253291 A1* 10/2009 Cheng ..... H01R 12/777
439/452

* cited by examiner

RELATED ART

CONNECTOR

This application claims priority under 35 U.S.C. § 119 (e) and the benefit of U.S. Provisional Application Ser. No. 62/572,684 filed on Oct. 16, 2017, the disclosure of which is incorporated by reference.

TECHNICAL FIELD

This invention relates to a connector.

BACKGROUND ART

For example, a connector 1 described in JP 2005-129490 A (Patent Literature 1) includes a metallic shell 2, a connector body 3, and a large number of signal line contacts 5. The metallic shell 2 described in Patent Literature 1 functions to shield against electromagnetic waves, and integrally includes a pair of grounding contacts 24a and 24b that correspond to grounding pads of a flexible printed circuit (FPC) 10.

In the connector 1 described in Patent Literature 1, as is apparent from FIG. 1(*a*) being a plan view of the connector 1 and from FIG. 1(*b*) being a perspective view of the connector 1, the plurality of signal line contacts 5 are arrayed in a right-and-left direction. As is clearly apparent from FIG. 1(*a*), in top view, the grounding contacts 24a and 24b are formed apart from the plurality of signal line contacts 5 on right and left sides of the plurality of signal line contacts 5.

That is, in top view of the connector 1 described in Patent Literature 1, the right grounding contact 24a is formed apart with a certain distance on the right side of the rightmost signal line contacts 5. Similarly, the left grounding contact 24b is formed apart with a certain distance on the left side of the leftmost signal line contacts 5.

SUMMARY OF THE INVENTION

Problems to be Solved by the Invention

However, when the distance between the right grounding contact 24a and the rightmost signal line contacts 5 and the distance between the left grounding contact 24b and the leftmost signal line contacts 5 are small, there is a fear in that a short circuit occurs. When the distance between the right grounding contact 24a and the rightmost signal line contacts 5 and the distance between the left grounding contact 24b and the leftmost signal line contacts 5 are large in contrast, there is a fear in that a size of the connector 1 in the right-and-left direction is increased.

In the connector 1 described in Patent Literature 1, such problems may similarly arise when contacts (terminals) other than the grounding contacts are provided in place of one or both of the signal line contacts 5 positioned at both ends among the signal line contacts 5. As the contacts other than the grounding contacts, power supply contacts can be exemplified.

This invention has been made in view of the above-mentioned circumstances, and has an object to provide a connector, which is capable of preventing terminals from being short-circuited with ground potential while preventing increase in size of the connector.

Means for Solving the Problems

To achieve the above-mentioned objection, this invention provides a connector, which is configured to connect an object including a ground connection portion by inserting the object into the connector from a rear side to a front side in a front-and-rear direction of the connector, the connector comprising:

a housing, which has a hole portion extending forward from an insertion slot for inserting the object;

a plurality of terminals, which are arranged in the hole portion of the housing;

a conductive shell, which is configured to at least partially cover the housing;

a grounding spring piece, which is electrically connected to the conductive shell, and is formed, apart from a terminal group including the plurality of terminals, at least one of a right side and a left side in a right-and-left direction orthogonal to the front-and-rear direction so that the grounding spring piece is brought into contact with the ground connection portion; and a partition wall, which extends between the terminal group and the grounding spring piece along the front-and-rear direction, and is configured to partition the terminal group and the grounding spring piece.

Effect of the Invention

According to this invention, it is possible to prevent the terminals from being short-circuited with the ground potential while preventing the increase in size of the connector.

DESCRIPTION OF THE EMBODIMENTS

Now, with reference to the drawings, a connector according to an embodiment of this invention is described. The same components are denoted by the same reference symbols in all of the drawings. Further, terms indicating directions of "up", "down", "front", "rear", "right", and "left" are used for description and are not intended to limit this invention.

<Configuration of Connector>

Figure 1:
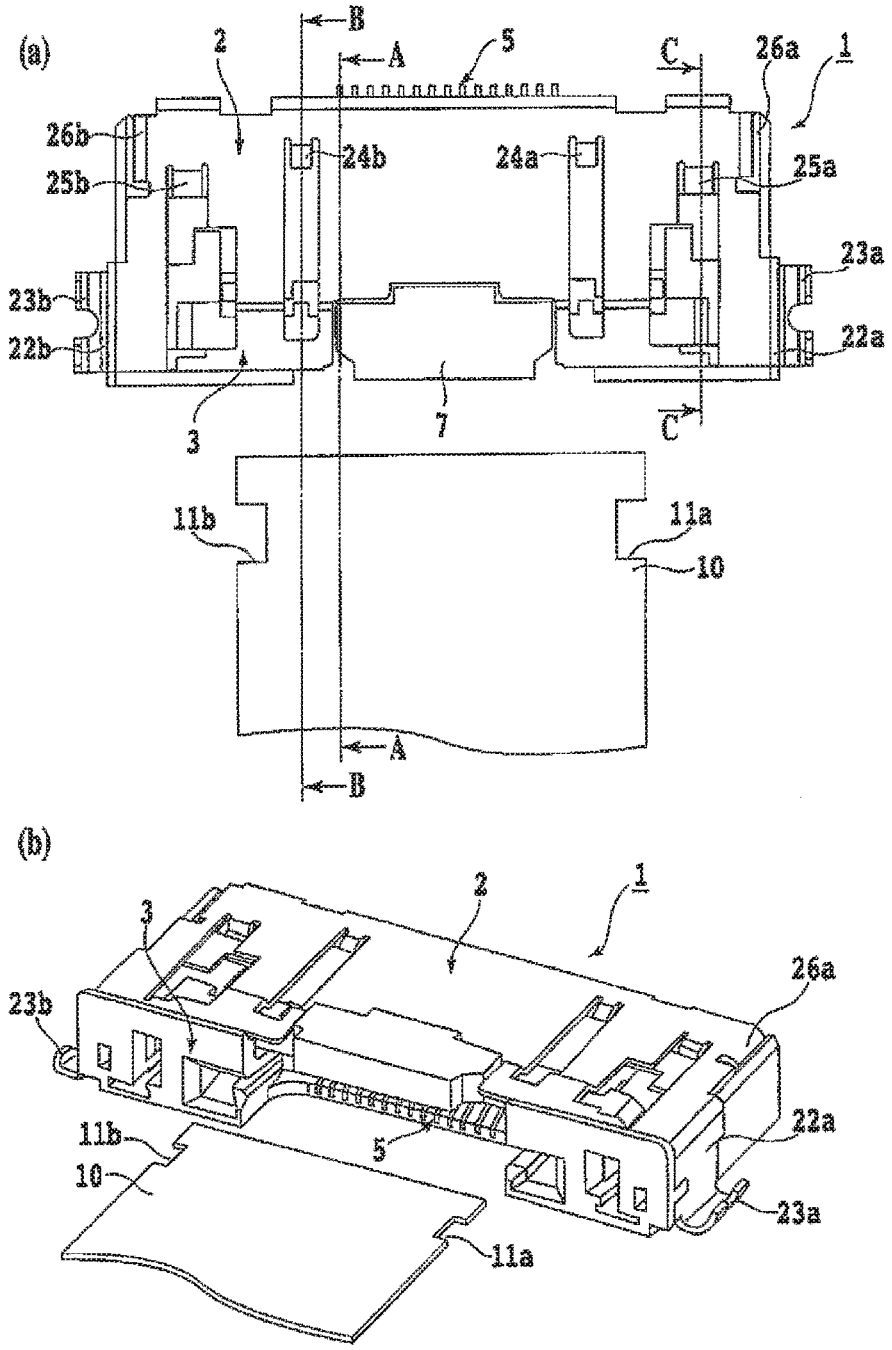
FIG. 1 includes views of an example of a connector according to an invention of the related art, in which FIG. 1(*a*) is a plan view thereof, and FIG. 1(*b*) is a perspective view thereof.
Figure 2:
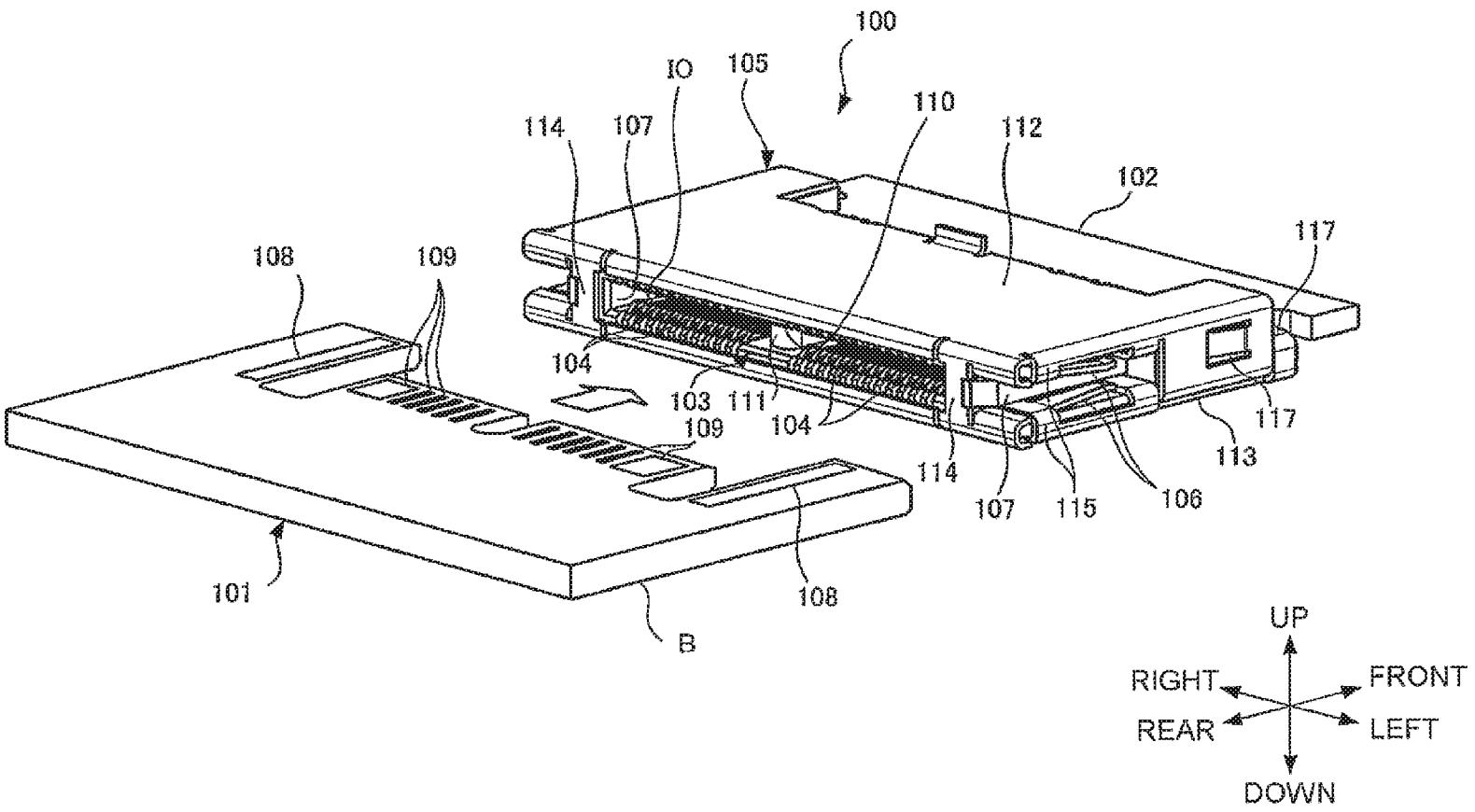
FIG. 2 is a perspective view of a connector according to an embodiment of this invention.
Figure 3:
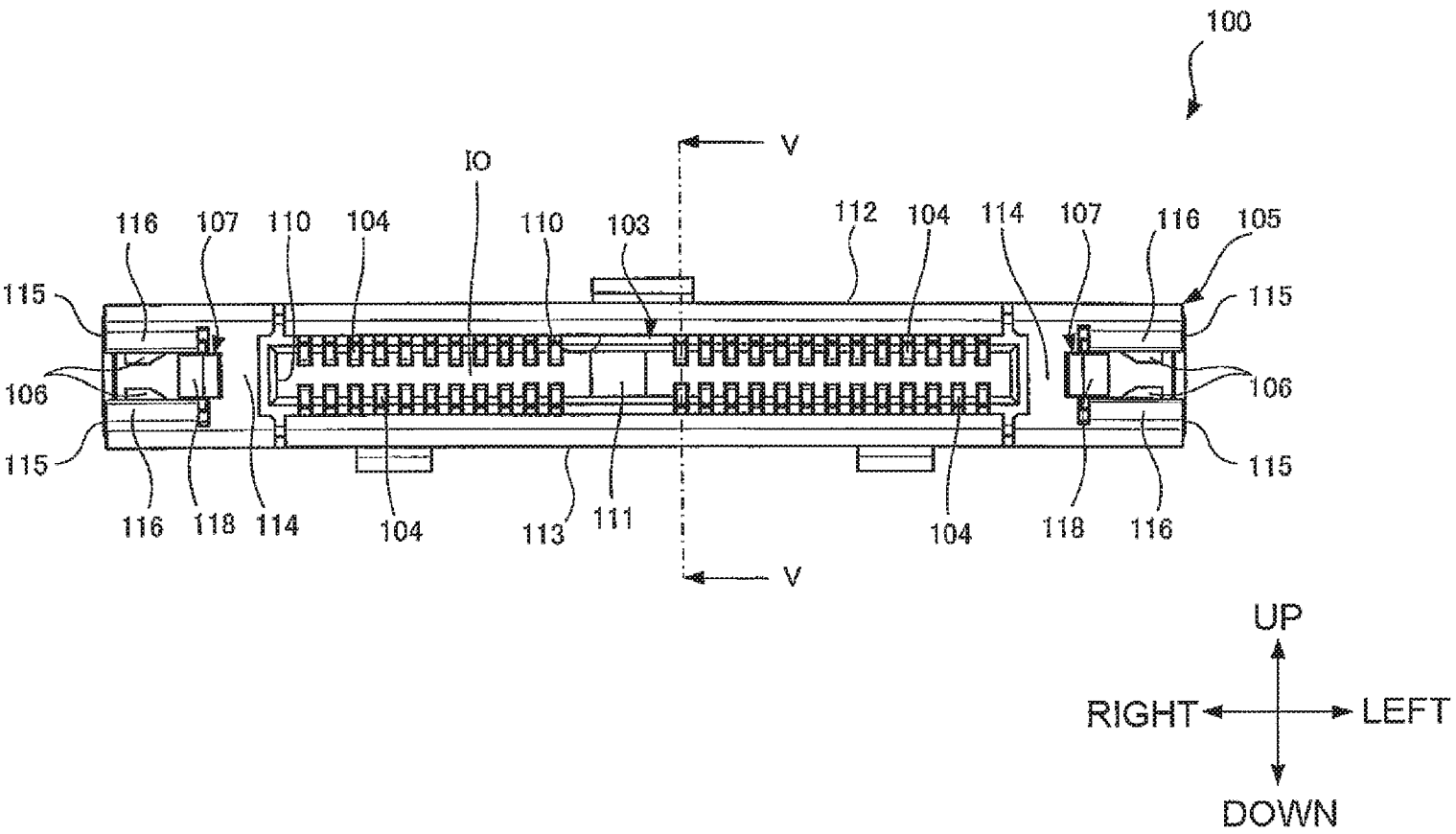
FIG. 3 is a rear view of the connector according to the embodiment.
Figure 4:
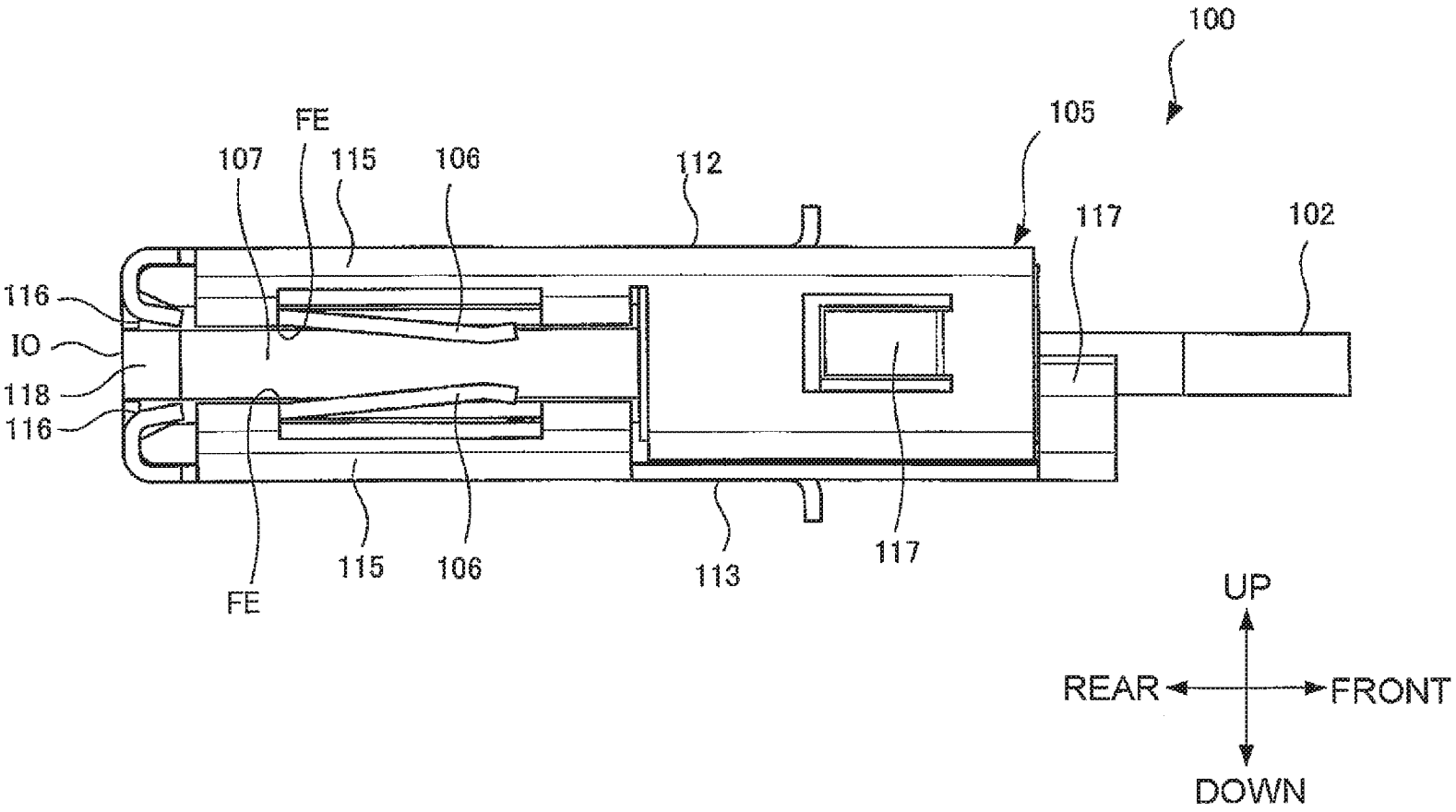
FIG. 4 is a left side view of the connector according to the embodiment.
Figure 5:
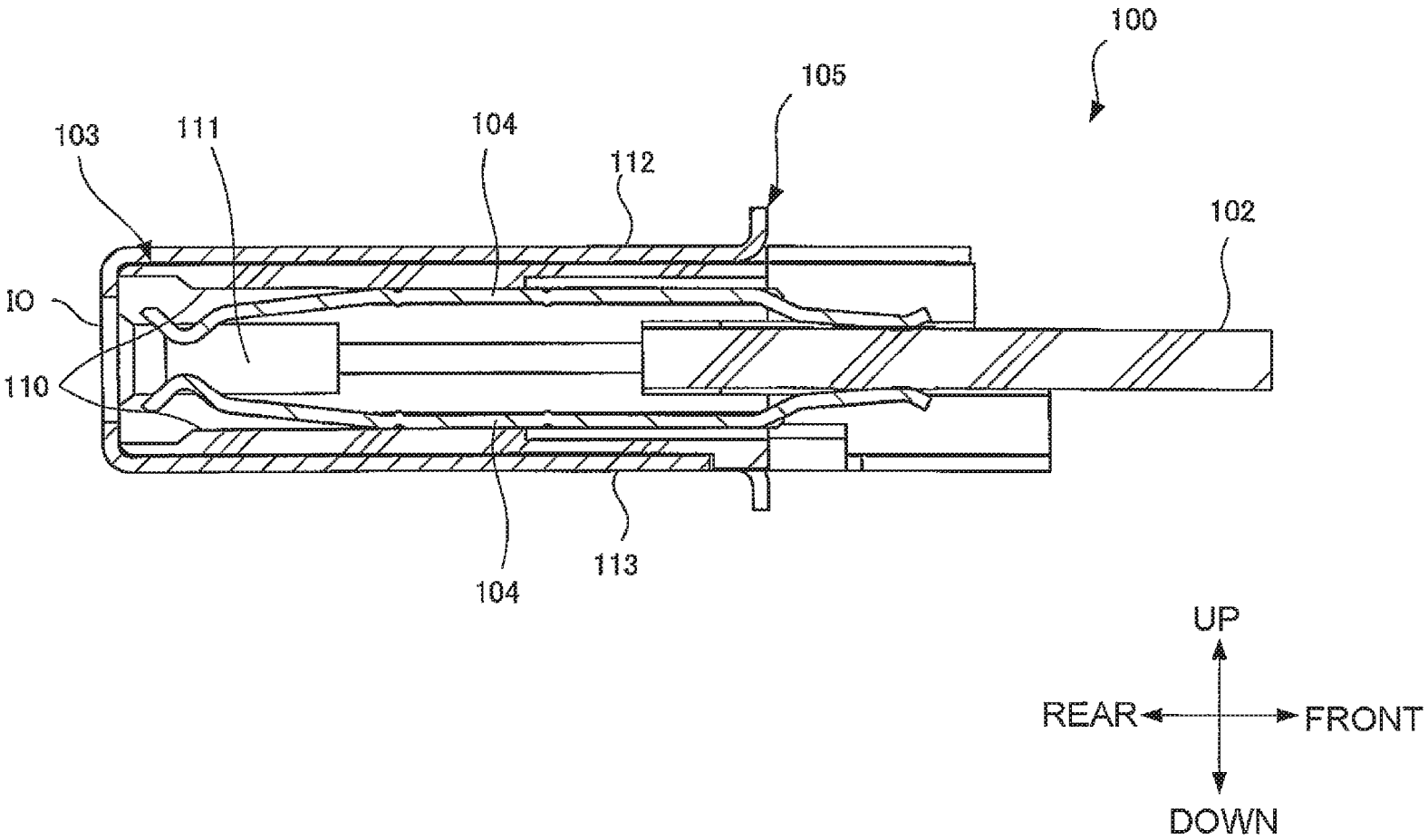
FIG. 5 is a sectional view taken along the line V-V of FIG. 3.

As illustrated in a perspective view of FIG. 2, a rear view of FIG. 3, a left side view of FIG. 4, and a sectional view of FIG. 5, a connector 100 according to the embodiment of this invention is an electronic component to which an object 101 is connected by inserting the object 101 into the connector 100 from a rear side to a front side in a front-and-rear direction of the connector. The connector 100 generally includes a board 102, a housing 103, a plurality of terminals 104, a conductive shell 105, four grounding spring pieces 106, and two partition walls 107.

Herein, as illustrated in FIG. 2, the object 101 is a printed circuit board including two grounding pads 108 and a plurality of terminal pads 109, which are arranged on each of an upper surface and a lower surface of a board B. On each surface of the object 101, the plurality of terminal pads 109 are arrayed in a right-and-left direction of the object 101 between the two grounding pads 108.

The four grounding pads 108 are provided to correspond to the four grounding spring pieces 106, respectively. The plurality of terminal pads 109 are provided to correspond to the plurality of terminals 104, respectively. When the object 101 is connected to the connector 100, the four grounding pads 108 serving as ground connection portions are brought into contact with and electrically connected to the four grounding spring pieces 106. Further, each of the plurality of terminal pads 109 is brought into contact with and electrically connected to any preset one of the plurality of terminals 104.

The above-mentioned object 101 is incorporated into, for example, a connector of a cable that is connected to a personal computer, a peripheral device (such as a printer or a hard disk drive) for a personal computer, or a docking station for connecting a personal computer to a peripheral device.

The board 102 is a printed circuit board including appropriate wiring.

The housing 103 has a hole portion 110 extending forward from an insertion slot 10 into which the object 101 is to be inserted. The housing 103 of this embodiment has a tubular shape extending in the front-and-rear direction with a substantially rectangular cross section formed of walls (an upper wall, a lower wall, a left side wall, and a right side wall) positioned on an upper side, a lower side, a left side, and a right side of the housing 103, respectively. The housing 103 further includes protruding portions that further protrude sideward from an upper end portion and a lower end portion of each side wall. In rear view, the hole portion 110 has a substantially rectangular shape. The board 102 is arranged in a preset front region of the hole portion 110. Further, a plurality of elongated grooves arrayed in the right-and-left direction are formed in a preset rear region of each of an upper surface portion and a lower surface portion of the hole portion 110. Right and left side surface portions of the hole portion 110 are formed of the partition walls 107 to be described later in detail.

Further, the housing 103 includes a pillar portion 111 formed at a substantially center of the hole portion 110 in the right-and-left direction in rear view. The pillar portion 111 can not only increase strength of the housing 103 but also prevent incorrect connection of the object that is not suitable for the connector 100.

In this embodiment, the hole portion 110 passes through the housing 103 in the front-and-rear direction, but the hole portion 110 is not always required to pass through the housing 103. That is, as long as the plurality of terminals 104 arranged in the hole portion 110 are configured to be connectable to, for example, the wiring of the external board 102, a front end portion of the hole portion 110 may be closed.

It is only necessary to form the housing 103 of an insulating material. Typically, the housing 103 is formed of a resin by injection molding.

The plurality of terminals 104 are each a conductive member obtained by curving a wire-shaped metal into a preset shape. A cross section of each of the terminals 104 taken along a plane perpendicular to a length direction thereof may be an appropriate shape such as a polygonal shape, a circular shape, or an oval shape. For example, the cross section of each of the terminals 104 has a rectangular shape.

The plurality of terminals 104 are respectively fixed in the grooves formed in the housing 103. In this manner, the plurality of terminals 104 are arranged in the hole portion 110 of the housing 103. The board 102 is arranged in the hole portion 110 of the housing 103 as described above, and each of the plurality of terminals 104 is electrically connected to an appropriately preset portion of the wiring formed on the board 102.

As a method of fixing the terminals 104 to the housing 103, an appropriate method may be adopted. For example, each of the terminals 104 is press-fitted into a groove so that each of the terminals 104 is fixed in a state of being pressed by wall portions defining the groove. Further, an adhesive and the like may be used as appropriate.

The conductive shell 105 is a metallic member provided for shielding against electromagnetic noise (electromagnetic shielding), and at least partially covers the housing 103. In this embodiment, for example, as illustrated in FIG. 2, the conductive shell 105 covers most of upper, lower, right, and left sides of the housing 103.

The conductive shell 105 of this embodiment is arranged so as to be held in contact with most of outer surfaces of the housing 103. However, the conductive shell 105 may be arranged so as to be partially or entirely apart from the outer surfaces of the housing 103 as appropriate within a range of not impairing the electromagnetic shielding function.

More specifically, the conductive shell 105 includes a first shell portion 112, a second shell portion 113, right and left coupling portions 114, four bending portions 115, and four shell guide portions 116. The conductive shell 105 is locked by locking pieces 117 so that the conductive shell 105 cannot be moved rearward with respect to the housing 103.

The first shell portion 112 is arranged above the housing 103. The first shell portion 112 is a substantially flat-plate-like portion arranged so as to be held in contact with an upper surface of the housing 103. In top view, the first shell portion 112 has a rectangular shape with a substantially rectangular cutout formed in a substantially front center thereof.

The second shell portion 113 is arranged below the housing 103. The second shell portion 113 is a substantially flat-plate-like portion arranged so as to be held in contact with a lower surface of the housing 103. In top view, the second shell portion 113 has a rectangular shape with a substantially rectangular cutout formed in a substantially front center thereof.

Each of the coupling portions 114 couples the first shell portion 112 and the second shell portion 113 to each other.

Further, in rear view, the right and left coupling portions 114 partially cover the right and left partition walls 107 to be described later in detail. That is, each of the coupling portions 114 is arranged rearward of a rear end portion of the corresponding partition wall 107 and, in rear view, at a position at which each of the coupling portions 114 partially overlaps the rear end portion of the corresponding partition wall 107.

The number of the coupling portions 114 may be one, or three or more. It is only necessary that, in rear view, the coupling portions 114 cover at least a part of one of the partition walls 107, and the coupling portions 114 may entirely cover one of the partition walls 107.

The bending portions 115 are portions being curved and extending from right and left end portions of the first shell portion 112 or the second shell portion 113 toward a space between the first shell portion 112 and the second shell portion 113.

More specifically, for example, each of the bending portions 115 connecting to the first shell portion 112 is curved from a left end portion or a right end portion of the first shell portion 112 so that a surface continuous with a lower surface of the first shell portion 112 is positioned on an inner side of a surface continuous with an upper surface of the first shell portion 112. With this configuration, each of the bending portions 115 connecting to the first shell portion 112 is curved so as to be close to the second shell portion 113, and then is further curved toward a center of the first shell portion 112 in the right-and-left direction. Thus, in this embodiment, the bending portions 115 connecting to the first shell portion 112 are curved toward the space between the first shell portion 112 and the second shell portion 113.

Further, for example, each of the bending portions 115 connecting to the second shell portion 113 is similarly curved from a right end portion or a left end portion of the second shell portion 113 so that a surface continuous with an upper surface of the second shell portion 113 is positioned on an inner side of a surface continuous with a lower surface of the second shell portion 113. With this configuration, each of the bending portions 115 connecting to the second shell portion 113 is curved so as to be close to the first shell portion 112, and then is further curved toward a center of the second shell portion 113 in the right-and-left direction. Thus, in this embodiment, similarly to the bending portions 115 connecting to the first shell portion 112, the bending portions 115 connecting to the second shell portion 113 are curved toward the space between the first shell portion 112 and the second shell portion 113.

Figure 6:
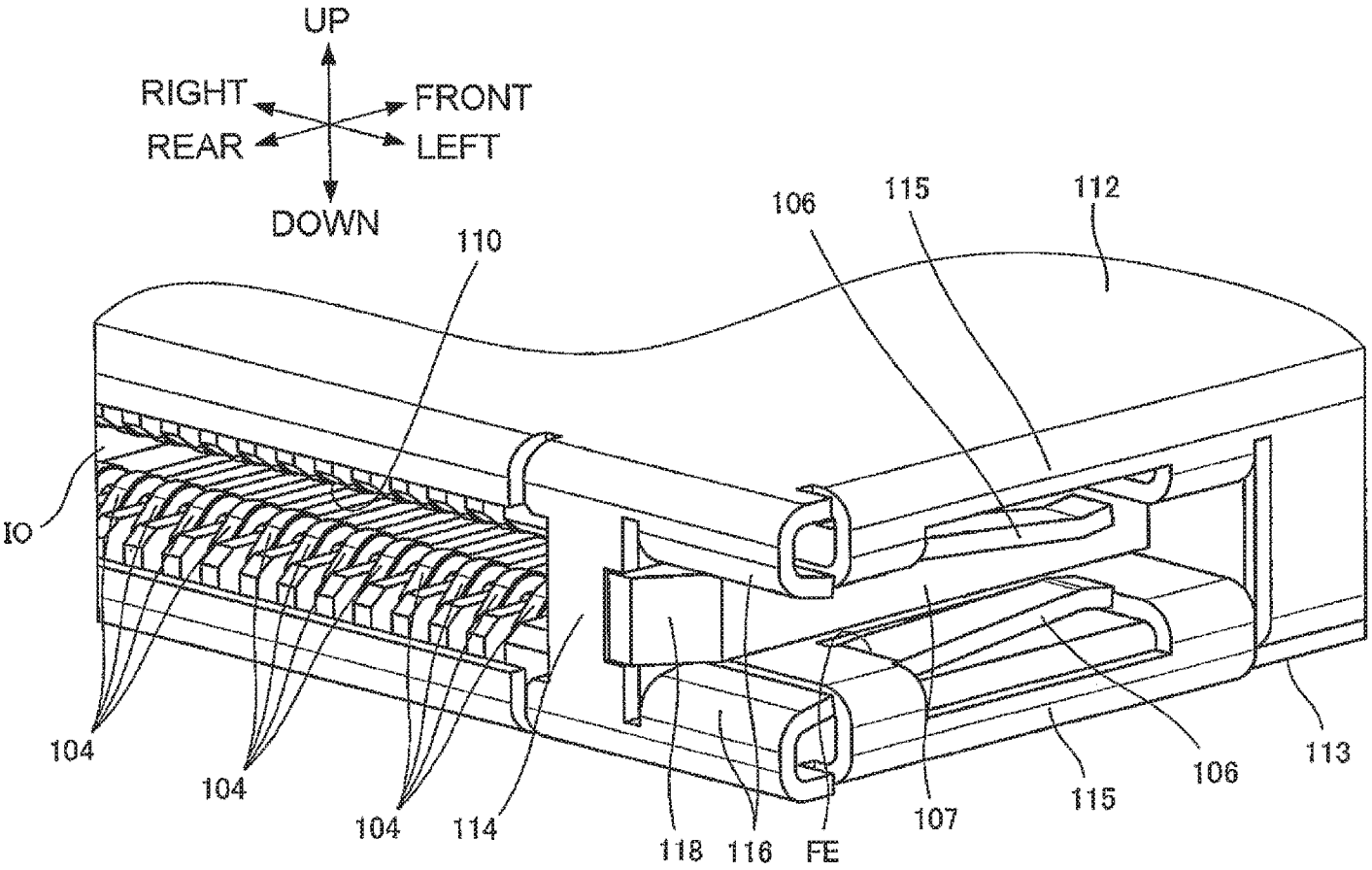
FIG. 6 is a perspective view for illustrating a vicinity of a left rear end portion of the connector according to the embodiment in an enlarged manner.

As illustrated in an enlarged perspective view of FIG. 6, the shell guide portions 116 are portions serving as second guide portions that are formed at rear end portions of the grounding spring pieces 106 in the front-and-rear direction to be described later in detail, and are configured to guide the object 101 to a preset position in an up-and-down direction of the connector.

Each of the shell guide portions 116 of this embodiment extends in a curved shape toward the space between the first shell portion 112 and the second shell portion 113 from a portion of a rear end portion of each of the first shell portion 112 and the second shell portion 113, which is positioned rearward of each of the grounding spring pieces 106.

More specifically, for example, each of the shell guide portions 116 is curved from the rear end portion of the first shell portion 112 positioned rearward of each of the grounding spring pieces 106 so that a surface continuous with the lower surface of the first shell portion 112 is positioned on an inner side of a surface continuous with the upper surface of the first shell portion 112. With this configuration, each of the shell guide portions 116 connecting to the first shell portion 112 is curved so as to be close to the second shell portion 113, and then is further curved toward a center of the first shell portion 112 in the front-and-rear direction. Thus, in this embodiment, the shell guide portions 116 connecting to the first shell portion 112 are curved toward the space between the first shell portion 112 and the second shell portion 113.

Further, for example, each of the shell guide portions 116 connecting to the second shell portion 113 is similarly curved from the rear end portion of the second shell portion 113 positioned rearward of each of the grounding spring pieces 106 so that a surface continuous with the upper surface of the second shell portion 113 is positioned on an inner side of a surface continuous with a lower surface of the second shell portion 113. With this configuration, each of the shell guide portions 116 connecting to the second shell portion 113 is curved so as to be close to the first shell portion 112, and then is further curved toward a center of the second shell portion 113 in the front-and-rear direction. Thus, in this embodiment, the shell guide portions 116 connecting to the second shell portion 113 are curved toward the space between the first shell portion 112 and the second shell portion 113, similarly to the shell guide portions 116 connected to the first shell portion 112.

As illustrated in FIG. 2 to FIG. 4 and FIG. 6, the four grounding spring pieces 106 are portions configured to determine ground potential of the object 101, and are formed integrally with the conductive shell 105. At positions apart from a terminal group constructed by the plurality of terminals 104 toward at least one of the right side and the left side in the right-and-left direction orthogonal to the front-and-rear direction, the four grounding spring pieces 106 are formed so as to be brought into contact with the corresponding grounding pads 108.

The grounding spring pieces 106 of this embodiment are formed on each of the first shell portion 112 and the second shell portion 113. The grounding spring pieces 106 formed on the first shell portion 112 are cantilevered so as to extend from a fixed end FE downward and forward. Further, the grounding spring pieces 106 formed on the second shell portion 113 are cantilevered so as to extend from the fixed end FE upward and forward.

The fixed ends FE of the four grounding spring pieces 106 are connected to and supported by the right and left bending portions 115.

In this embodiment, the right and left two grounding spring pieces 106 are formed on the first shell portion 112. The fixed end FE of the left grounding spring piece 106 formed on the first shell portion 112 is connected to and supported by the bending portion 115 extending from the left end portion of the first shell portion 112. The fixed end FE of the right grounding spring piece 106 formed on the first shell portion 112 is connected to and supported by the bending portion 115 extending from the right end portion of the first shell portion 112.

In this embodiment, similarly to the grounding spring pieces 106 formed on the first shell portion 112, the right and left two grounding spring pieces 106 are formed on the second shell portion 113. The grounding spring pieces 106 are also formed on the second shell portion 113 in a mode of replacing the first shell portion 112 with the second shell portion 113 in the above description relating to the grounding spring pieces 106 formed on the first shell portion 112.

The number of the grounding spring pieces may be changed as appropriate as long as one or more grounding spring pieces are formed.

Each of the partition walls 107 extends between the terminal group constructed by the plurality of terminals 104, and the grounding spring pieces 106 along the front-and-rear direction. With this configuration, the terminal group and the grounding spring pieces 106 are partitioned by the partition walls 107. In this embodiment, the partition walls 107 are side walls constructing the housing 103. The partition walls 107 may be formed separately from the side walls constructing the housing 103.

The partition walls 107 of this embodiment connect upper and lower surfaces of the housing 103 continuously without a gap. Thus, a space between the terminal group constructed by the plurality of terminals 104, and the grounding spring pieces 106 is mutually shielded without a gap over entire lengths of the terminal group and the grounding spring pieces 106 in the front-and-rear direction. Accordingly, a short circuit can be prevented from occurring between any one of the terminals 104 and any one of the grounding spring pieces 106 due to dust and the like.

The partition walls 107 each include a partition guide portion 118 formed in a preset range of a rear end portion thereof. The partition guide portion 118 is a portion serving as a first guide portion that is configured to guide the object 101 to a preset position in the right-and-left direction using a dimension of the partition guide portion 118 in the right-and-left direction that gradually increases toward the front side.

The partition guide portion 118 of this embodiment is formed on an outer portion of the rear end portion, and forms an inclined surface inclined so as to gradually protrude forward and outward.

Herein, the outer portion of the rear end portion of the partition guide portion 118 refers to an outer portion of a side portion of the rear end portion, that is, a left end portion of the rear end portion in the left partition guide portion 118, and a right end portion of the rear end portion in the right partition guide portion 118. An outer side of the partition guide portion 118 refers to a side of one of the right and left partition guide portions 118 far from another one of the right and left partition guide portions 118. More specifically, the outer side of the partition guide portion 118 refers to the left side in the left partition guide portion 118, and the right side in the right partition guide portion 118.

<Method of Manufacturing Connector>

The configuration of the connector 100 according to the embodiment of this invention is described above. Now, a method of manufacturing the connector 100 according to this embodiment is described.

A metal plate 119 for producing the conductive shell 105 is prepared. The metal plate 119 is a metallic flat plate having a shape illustrated in FIG. 7. In order to enable production of the above-mentioned conductive shell 105 only by bending the metal plate 119 as appropriate, cutouts are formed in the metal plate 119.

Figure 7:
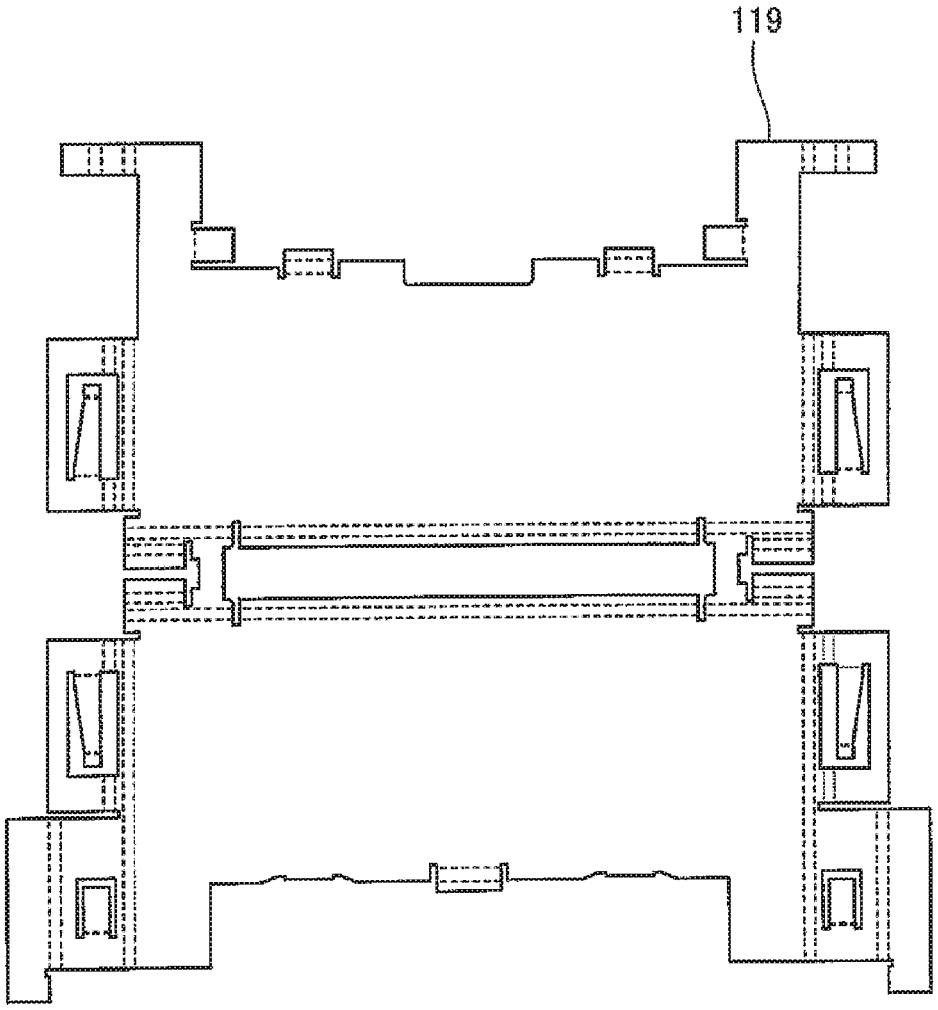
FIG. 7 is a view for illustrating a first step of a method of manufacturing the connector according to the embodiment, and an example of a metal plate to be used for producing a conductive shell.
Figure 8:
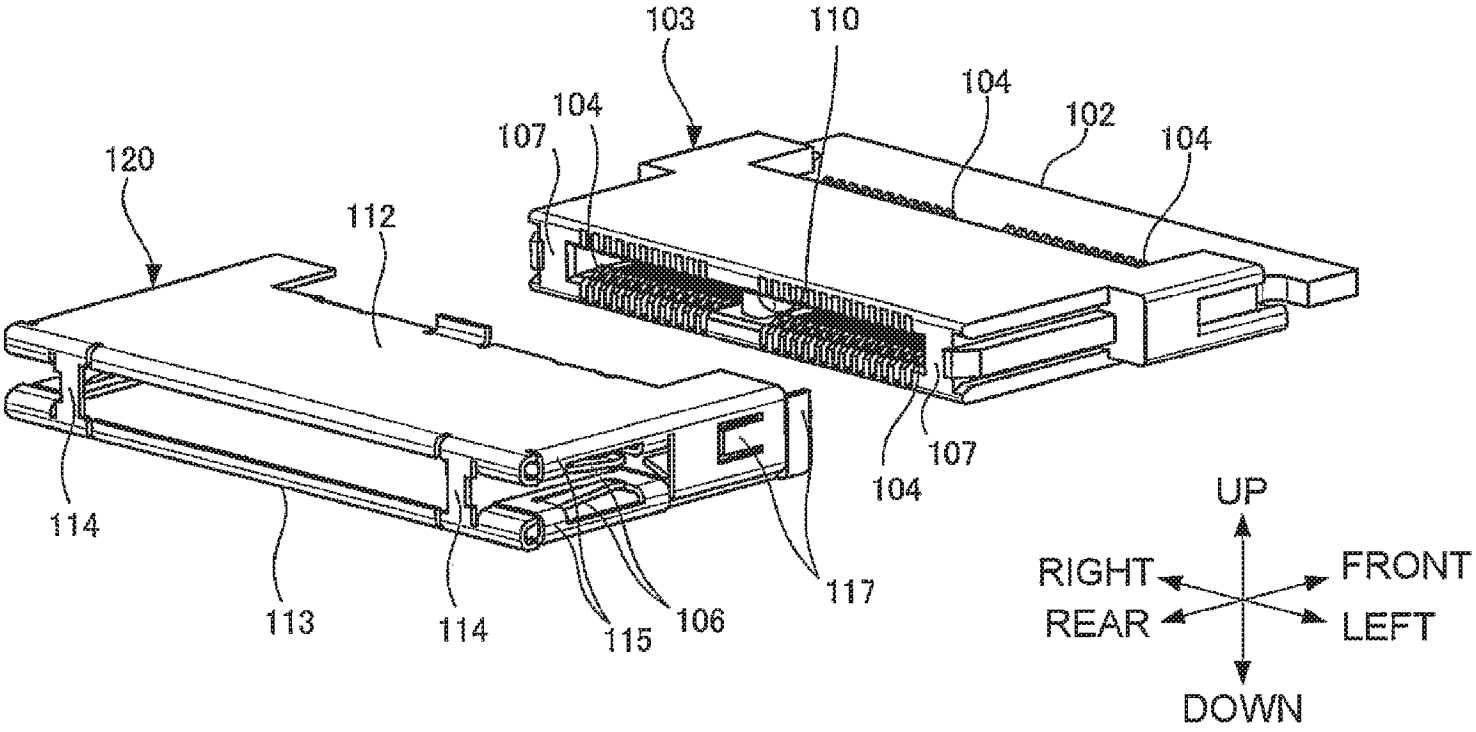
FIG. 8 is a perspective view for illustrating a second step of the method of manufacturing the connector according to the embodiment.

The metal plate 119 illustrated in FIG. 7 is bent by a method determined in terms of design, thereby producing a conductive shell 120 before assembly illustrated in FIG. 8. Further, as illustrated in FIG. 8, there is prepared the housing 103 including the board 102, which is inserted into the housing 103 from the front side and fixed in the housing 103, and the plurality of terminals 104 mounted to the housing 103.

Description is made of an example in which the metal plate 119 of this embodiment is a solid metallic plate. However, it is only necessary that the metal plate 119 be a conductive plate-like member. The metal plate 119 may have a mesh shape with one or a plurality of holes.

Figure 9:
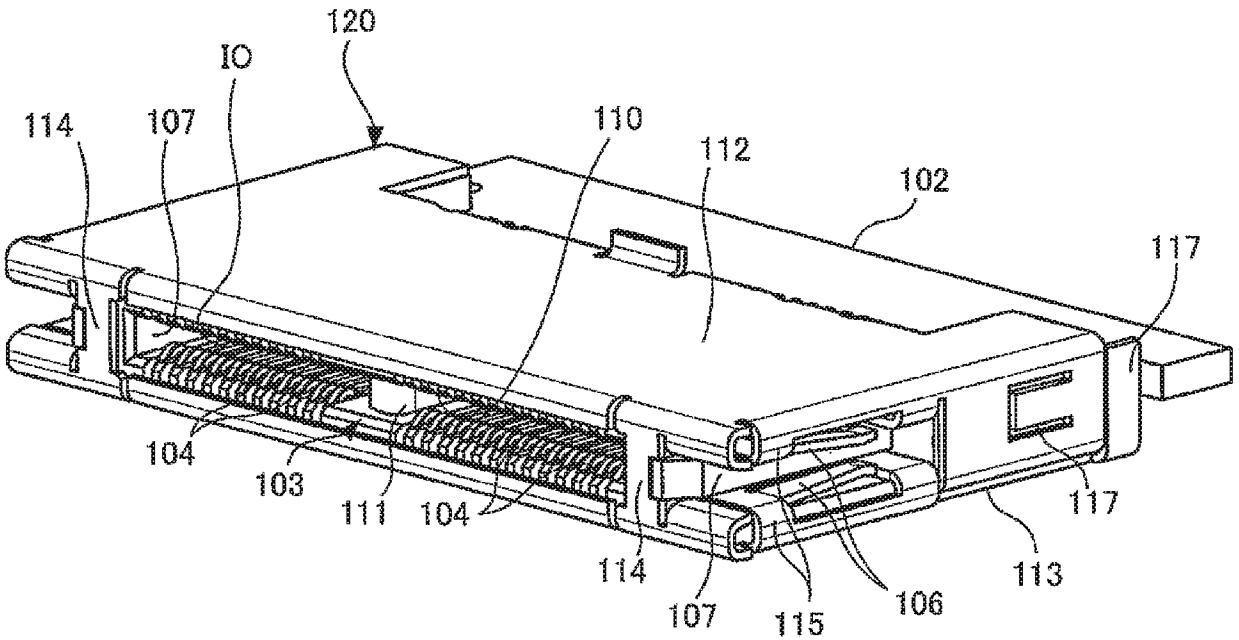
FIG. 9 is a perspective view for illustrating a third step of the method of manufacturing the connector according to the embodiment.

From the front side of the conductive shell 120 before assembly, the housing 103 including the board 102 and the plurality of terminals 104 mounted thereto is inserted into the conductive shell 120. In this manner, as illustrated in FIG. 9, the conductive shell 120 before assembly is fitted in the housing 103 including the board 102 and the plurality of terminals 104 mounted thereto.

The conductive shell 105 is fixed to the housing 103 so that the conductive shell 105 cannot be moved rearward with respect to the housing 103 by bending the locking pieces 117 (see FIG. 9) formed on the conductive shell 120 before assembly. In this manner, as illustrated in FIG. 2, the conductive shell 105 is assembled to the housing 103, thereby completing the connector 100.

<Operations and Effects>

As described above, according to this embodiment, there are provided the partition walls 107 configured to partition the terminal group constructed by the plurality of terminals 104, and the grounding spring pieces 106 formed integrally with the conductive shell 105. Thus, without setting large distances between the plurality of terminals 104 and the grounding spring pieces 106, the partition walls 107 can prevent the short circuit between the plurality of terminals 104 and the grounding spring pieces 106. Therefore, while preventing increase in size of the connector 100, it is possible to prevent the plurality of terminals 104 from being short-circuited with the ground potential.

Further, the partition walls 107 extend along the front-and-rear direction. Thus, when the object 101 is connected to the connector 100, the partition walls 107 can guide the object 101. Accordingly, the terminals 104 and the grounding spring pieces 106 of the connector 100, and the terminal pads 109 and the grounding pads 108 of the object 101 can be easily arranged so as to have preset and corresponding positional relationships in the right-and-left direction. Therefore, the connector 100 and the object 101 can easily be connected to each other.

In this embodiment, the partition walls 107 are the side walls constructing the housing 103. Accordingly, it is not necessary to form the partition walls 107 separately from the side walls, and hence increase in size of the housing 103 in the right-and-left direction can be prevented. Therefore, increase in size of the connector 100, in particular, increase in size of the connector 100 in the right-and-left direction can be prevented.

In this embodiment, the partition walls 107 each include the partition guide portion 118 configured to guide the object 101. With this configuration, the terminals 104 and the grounding spring pieces 106 of the connector 100, and the terminal pads 109 and the grounding pads 108 of the object 101 are more easily arranged so as to have the preset and corresponding positional relationships in the right-and-left direction. Therefore, the connector 100 and the object 101 can be more easily connected to each other.

In this embodiment, the coupling portions 114 are formed to couple the first shell portion 112 and the second shell portion 113 to each other. Thus, the conductive shell 105 can be produced from one metal plate 119 as illustrated in FIG. 7. This integration of the conductive shell 105 reduces the number of components, and hence assembly can be facilitated.

Further, the coupling portions 114 couple the first shell portion 112 and the second shell portion 113 to each other, thereby increasing strength of the conductive shell 105. As a result, for example, the first shell portion 112 and the second shell portion 113 can be prevented from being apart from each other in the up-and-down direction at the rear end portion of the conductive shell 105.

In addition, the coupling portions 114 cover the partition walls 107 in rear view. With this configuration, the rear end portions of the partition walls 107 can be protected by the coupling portions 114. In general, when the object 101 is pulled out of and inserted into the connector, the object 101 may collide with the rear end portions of the partition walls 107. However, the rear end portions of the partition walls 107 can be prevented from being damaged by the collision.

In this embodiment, the grounding spring pieces 106 are formed on both upper and lower sides of the conductive shell 105. Thus, when the object 101 is arranged between the grounding spring pieces 106, the object 101 can be positioned in the up-and-down direction substantially accurately. Therefore, the object 101 can easily be connected to an accurate position.

In this embodiment, each of the first shell portion 112 and the second shell portion 113 includes the bending portions 115, and the fixed ends FE of the four grounding spring pieces 106 are connected to and supported by the bending portions 115, respectively. Thus, the conductive shell 105 integrally including the four grounding spring pieces 106 can be produced from one metal plate 119 illustrated in FIG. 7. This integration of the conductive shell 105 reduces the number of components, and hence assembly can be facilitated.

In this embodiment, the conductive shell 105 includes the shell guide portions 116 configured to guide the object. The object 101 is more easily positioned in the up-and-down direction substantially accurately. Therefore, the object 101 can more easily be connected to the accurate position.

In this embodiment, a combination of the partition wall 107 and the grounding spring pieces 106 is provided on each of the right side and the left side of the terminal group constructed by the plurality of terminals 104. Thus, while grounding is securely established through the four grounding spring pieces 106, the plurality of terminals 104 can be prevented from being short-circuited with the ground potential.

One embodiment of this invention is described above, but this embodiment may be modified as follows.

For example, in the embodiment, the partition wall 107 isolates the terminal group and the grounding spring pieces 106 from each other without a gap. However, the partition wall 107 configured to partition the terminal group and the grounding spring pieces 106 may have one or a plurality of holes passing through the partition wall 107 in the right-and-left direction, or may have a cutout or the like.

However, it is desired that, in view of preventing the short circuit between any one of the terminals 104 and the grounding spring pieces 106 by the partition wall 107, the partition wall 107 be provided so that the terminal 104 closest to the partition wall 107, and the grounding spring pieces 106 are mutually hidden by the partition wall 107 in side view.

That is, it is desired that the left partition wall 107 be provided to hide the leftmost terminal 104 in left side view, and be provided to hide the left grounding spring pieces 106 in right side view. Further, it is desired that the right partition wall 107 be provided to hide the rightmost terminal 104 in right side view, and be provided to hide the right grounding spring pieces 106 in left side view.

As described above, when the partition wall 107 is provided so that the terminal 104 closest to the partition wall 107, and the grounding spring pieces 106 are mutually hidden by the partition wall 107 in side view, a risk of causing the short circuit between the terminals 104 and the grounding spring pieces 106 due to dust and the like is reduced. Therefore, it is possible to prevent the short circuit between any one of the terminals 104 and any one of the grounding spring pieces 106.

Further, for example, in the embodiment, description is made of the example in which the grounding spring pieces 106 are formed integrally with the conductive shell 105. However, the grounding spring pieces 106 may be formed as members provided separately from the conductive shell 105. In this case, for example, it is preferred that the grounding spring pieces 106 be electrically connected to the conductive shell 105, and be fixed to positions similar to the positions of the connector 100 according to the embodiment. As this fixing method, for example, a method of fixing the grounding spring pieces 106 to the housing 103 with an adhesive, screws, or the like can be exemplified.

In this modification example, there are provided the partition walls 107 configured to partition the terminal group constructed by the plurality of terminals 104, and the grounding spring pieces 106 electrically connected to the conductive shell 105. Accordingly, similarly to the embodiment, without setting the large distances between the plurality of terminals 104 and the grounding spring pieces 106, the partition walls 107 can prevent the short circuit between the plurality of terminals 104 and the grounding spring pieces 106. Therefore, while preventing increase in size of the connector 100, it is possible to prevent the plurality of terminals 104 from being short-circuited with the ground potential.

In the above, the embodiment and the modification example of this invention are described. However, this invention is not limited to the embodiment and the modification example. For example, this invention may include a mode in which the embodiment and the modification example described above are partially or entirely combined in a suitable manner or a mode suitably changed from the mode of combination.

DESCRIPTION OF SYMBOLS

100 connector
101 object
102, B board
103 housing
IO insertion slot
104 terminal
105 conductive shell
106 grounding spring piece
107 partition wall
108 grounding pad
109 terminal pad
110 hole portion
111 pillar portion
112 first shell portion
113 second shell portion
FE fixed end
114 coupling portion
115 bending portion
116 shell guide portion
117 locking pieces
118 partition guide portion
119 metal plate
120 conductive shell before assembly

What is claimed is:

1. A connector, which is configured to connect an object including a ground connection portion by inserting the object into the connector from a rear side to a front side in a front-and-rear direction of the connector, the connector comprising:

a housing, which has a hole portion extending forward from an insertion slot for inserting the object;

a plurality of terminals, which are arranged in the hole portion of the housing;

a conductive shell, which is configured to at least partially cover the housing;

a grounding spring piece, which is electrically connected to the conductive shell, and is formed, apart from a terminal group including the plurality of terminals, at least one of a right side and a left side in a right-and-left direction orthogonal to the front-and-rear direction so that the grounding spring piece is brought into contact with the ground connection portion; and a partition wall, which extends between the terminal group and the grounding spring piece along the front-and-rear direction, and is configured to partition the terminal group and the grounding spring piece.

2. A connector according to claim 1, wherein the partition wall is a side wall forming the housing.

3. A connector according to claim 1, wherein the partition wall includes a first guide portion, which is configured to have a dimension in the right-and-left direction that gradually increases toward the front side so that the object is guided.

4. A connector according to claim 1, wherein the conductive shell includes:

a first shell portion arranged above the housing;

a second shell portion arranged below the housing; and a coupling portion configured to couple the first shell portion and the second shell portion to each other, and wherein the coupling portion at least partially covers the partition wall as viewed from the rear side.

5. A connector according to claim 4, wherein the grounding spring piece is one of a plurality of the grounding spring pieces, wherein each of the plurality of grounding spring pieces is formed on the first shell portion and the second shell portion, wherein the grounding spring piece formed on the first shell portion is cantilevered so as to extend from a fixed end downward and forward, and wherein the grounding spring piece formed on the second shell portion is cantilevered so as to extend from a fixed end upward and forward.

6. A connector according to claim 5, wherein each of the first shell portion and the second shell portion includes right and left bending portions, being curved and extending from right and left end portions of each of the first shell portion and the second shell portion toward a space between the first shell portion and the second shell portion, and wherein the fixed ends of the plurality of grounding spring pieces are connected to and supported by the right and left bending portions.

7. A connector according to claim 1, wherein the conductive shell includes a second guide portion that is formed at a rear end portion of at least one of the plurality of grounding spring pieces in the front-and-rear direction, and is configured to guide the object.

8. A connector according to claim 1, wherein the partition walls and a plurality of the grounding spring pieces are formed on both the right and left sides of the terminal group.

* * * * *